US009186689B2

(12) United States Patent
Kim

(10) Patent No.: US 9,186,689 B2
(45) Date of Patent: Nov. 17, 2015

(54) CAP-INTEGRATED PUMPING TYPE COSMETIC CONTAINER

(71) Applicant: YONWOO CO., LTD., Incheon, KS (US)

(72) Inventor: Ah-Young Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 85 days.

(21) Appl. No.: 14/059,914

(22) Filed: Oct. 22, 2013

(65) Prior Publication Data

US 2015/0108171 A1 Apr. 23, 2015

(51) Int. Cl.
*B05B 11/00* (2006.01)
*A45D 40/00* (2006.01)

(52) U.S. Cl.
CPC ..... *B05B 11/3001* (2013.01); *A45D 40/00* (2013.01); *B05B 11/3059* (2013.01); *B05B 11/3097* (2013.01); *B05B 11/306* (2013.01); *B05B 11/3047* (2013.01)

(58) Field of Classification Search
CPC ..... B05B 11/3001; B05B 11/3045; B05B 11/3047; B05B 11/306; B05B 11/3052; B05B 11/3059; B05B 11/3097; B65D 47/20; B65D 23/06
USPC ..... 222/321.3, 321.6–321.9, 256, 384, 571, 222/182, 153.13, 519
See application file for complete search history.

(56) References Cited

U.S. PATENT DOCUMENTS

| | | | | |
|---|---|---|---|---|
| 6,290,103 | B1 * | 9/2001 | Fraillon | 222/321.1 |
| 6,405,904 | B1 * | 6/2002 | De Laforcade | 222/321.3 |
| 6,477,743 | B1 * | 11/2002 | Gross et al. | 222/525 |
| 7,775,402 | B2 * | 8/2010 | Yoshida et al. | 222/153.13 |
| 7,874,461 | B2 * | 1/2011 | Bae | 222/153.13 |
| 8,439,230 | B2 * | 5/2013 | Hagen | 222/153.13 |
| 8,490,837 | B2 * | 7/2013 | Michaux et al. | 222/153.13 |
| 8,550,306 | B2 * | 10/2013 | Angus et al. | 222/153.11 |
| 8,695,852 | B2 * | 4/2014 | Bertin et al. | 222/153.13 |
| 8,857,671 | B2 * | 10/2014 | Muller et al. | 222/321.9 |

* cited by examiner

*Primary Examiner* — Frederick C Nicolas
(74) *Attorney, Agent, or Firm* — IPLA P.A.; James E. Bame

(57) ABSTRACT

The cap-integrated pumping type cosmetic container is provided, which has features in that as a cap integrated with a rotation member ascends and descends when a rotation member engaged to the top of a container body rotates, a discharge port is opened and closed, so the present invention makes it possible to open and close the discharge port in an easier way.

6 Claims, 7 Drawing Sheets

CAP-INTEGRATED PUMPING TYPE COSMETIC CONTAINER

BACKGROUND

The present invention relates to a cap-integrated pumping type cosmetic container, and in particular to a cap-integrated pumping type cosmetic container in which a cap integrated with a rotation member ascends and descends when a rotation member engaged to the top of a container body rotates, for thereby opening and closing a discharge port, which makes it possible to open and close a discharge port in an easier way.

A pumping type cosmetic container is generally designed to discharge contents outside with the aid of a pumping operation of a pumping member engaged to the top of a container body. The pumping type cosmetic container comprises a container body which stores contents, a pumping member which is engaged to the top of the container body and makes the interior of the container body a vacuum state for thereby pumping up the contents with the aid of the pumping operation, and a button part which is positioned at the top of the pumping member and ascends and descends as a user pressurizes for thereby transferring a pressure to the pumping member.

The thusly constituted pumping type cosmetic container has features in that an over cap is engaged to the top of the container body and is detachable covering the button part for the purpose of preventing impurities from being inputted through a discharge hole formed at the button part and preventing the error operations of the pumping member which happen as the button part is pressurized irrespective of a user's intention.

Since the above mentioned over cap is detachably engaged to the container body, the over cap may be detached and lost or the over cap may be damaged due to a user's carelessness in a state that the over cap is disengaged.

The Korean Utility Model Registration No. 20-0345994 discloses "a cosmetic container with an appearing and disappearing type discharge port which is designed to improve the problems encountered in the earlier described cosmetic container.

The above mentioned Utility Model has features in that the cosmetic container characterized in that a discharge port engaged to a pump body of a container appears and disappears from an outer container as the container with the pump body ascends and descends in the outer container comprises:

an outer container configured in such a way that an input concave groove into which a discharge port engaged to a stem of the pump body of the container passes through the center of the top whose shoulder portion is smoothly curved, and at the bottom of the inner side is formed in an opposing direction a vertical guide groove guiding in a vertical direction a vertical guide protrusion formed at an intermediate portion of the outer surface of the container, and a rotation cap is undercut-engaged to the bottom and has a helical groove guiding the guide protrusion of the bottom of the container; and a container configured in such a way that to its top is engaged a pump body which mounts a discharge port 123 positioned at the input concave groove of the outer container, and at its intermediate portion of the outer surface is formed a vertical guide protrusion positioned at the vertical guide groove of the outer container, and at its lower side is formed a guide protrusion which is guided by the helical groove of the rotation cap when it ascends and descends.

The above described Utility Model has features in that as the rotation cap rotates, the guide protrusion of the container inserted in the helical groove of the rotation cap moves along the helical groove, so the container can ascend and descend. Since the discharge port is configured to appear and disappear from the outer container as the container ascends and descends, the error operations of the pumping member can be prevented unless an over cap is additionally provided, and the impurities can be prevented from inputting inside through the discharge hole.

The above described Utility Model is configured in a dual container structure formed of a container which stores contents, and an outer container containing the container, so the container itself storing the contents can ascend and descends by means of the rotation of the rotation cap. In this case, it is not easy to open and close the discharge port 123 due to the weight of the container.

The above described Utility Model is formed in a dual container structure, so the number of necessary parts increases, which leads to the increased manufacture costs. For the complicated assembling structures, productivity is bad.

SUMMARY OF THE INVENTION

Accordingly, it is an object of the present invention to provide a cap-integrated pumping type cosmetic container which improves the above mentioned problems and in which a cap integrated with a rotation member ascends and descends when a rotation member engaged to the top of a container body rotates, for thereby opening and closing a discharge port, which makes it possible to open and close a discharge port in an easier way.

It is another object of the present invention to provide a cap-integrated pumping type cosmetic container which makes it possible to lower the product prices in such a way to make a container body of a single container structure, and makes it possible to enhance the productivity thanks to the simple assembling procedures.

In order to achieve the above objects, there is provided a cap-integrated pumping type cosmetic container, comprising a container body which stores contents and includes a discharge part including at its top a discharge part for discharging contents; an ascending and descending guide member which is engaged to the discharge part of the container body and includes a pair of opposed helical grooves at both sides of an outer surface; a rotation member which is rotatable-engaged at the top of the container body and surrounds the ascending and descending guide member and has at an inner surface a vertical guide groove in a longitudinal direction; a cap which is inserted in the interior of the ascending and descending guide member and ascends and descends therein and has a guide protrusion which is formed at both sides of an outer surface and is inserted into a helical groove and a vertical guide groove; a pumping member which is engaged to a discharge part of the container body and discharges the contents through the pumping operations; and a button part which is engaged to the top to the pumping member and transfers a pressure to the pumping member and has a discharge port which opens and is closed as the cap ascends and descends.

In addition, below a button part is provided a pumping prevention member which is mounted at the bottom of the cap when the cap ascends for thereby limiting a downward movement of the button part.

In addition, at the bottom of the inner side of the cap is provided a pumping prevention shoulder which surrounds the inner surface and supports the bottom of the pumping prevention member.

In addition, to the top of the pumping member is engaged a content suction part which is capable of sucking back the contents remaining at the front end of the discharge port, said content suction part, comprising a content movement tube which is engaged to the top of the pumping member and forms a space through which the contents from the pumping member move; a content suction tube which extends upward from the content movement tube and comes into close contact with an inner surface of the button part; and a spring support shoulder which surrounds the content movement tube at a certain distance and supports a second spring installed at the bottom of the button part and provides an elastic force to the button part.

In addition, the content suction tube is formed in a piston shape which comes into close contact with an inner surface of the button part, and a vacuum pressure is generated in the interior of the button part when the button part ascends by means of an elastic force of the second spring, for thereby sucking back the contents remaining at a front end of the discharge port.

In addition, at the top of the container body is provided a rotation prevention protrusion configured to prevent the rotation of the ascending and descending guide member, and at the bottom of the ascending and descending guide member is formed a rotation prevention groove which is engaged to the rotation prevention protrusion.

The above described present invention has advantageous features in that a cap integrated with a rotation member ascends and descends when a rotation member engaged to the top of a container body rotates, for thereby opening and closing a discharge port, which makes it possible to open and close a discharge port in an easier way.

The cap-integrated pumping type cosmetic container according to the present invention makes it possible to lower the product prices in such a way to make a container body of a single container structure, and makes it possible to enhance the productivity thanks to the simple assembling procedures.

In addition, since it is possible to prevent the contents from being discharged outside in such a way to suck back the contents remaining at the front end of the discharge port through a content suction part after the discharge of the contents is completed, over consumption of contents can be prevented, and the container can be prevented from the contaminations of the contents.

DETAILED DESCRIPTION OF THE INVENTION

Figure 1:
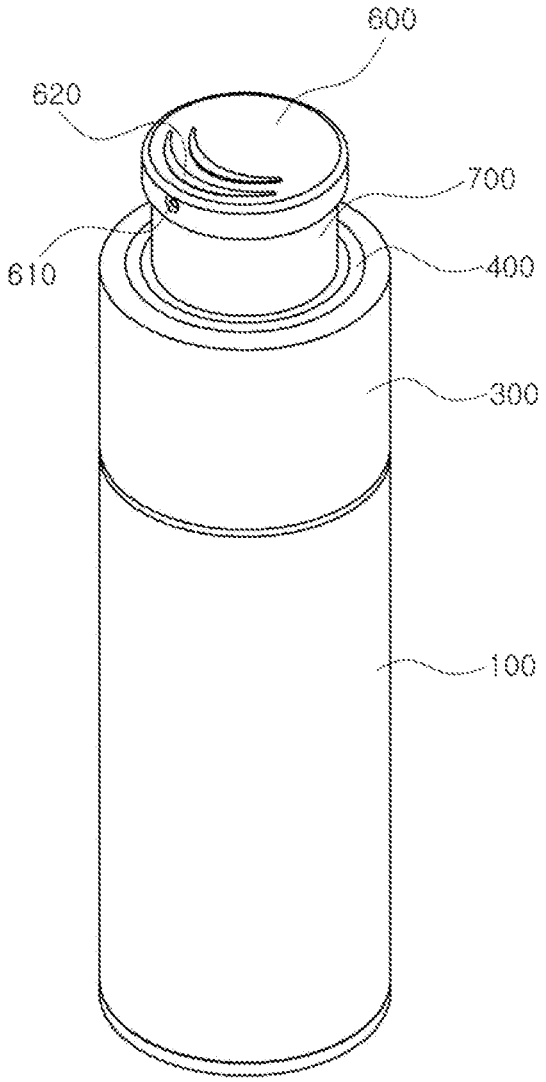
FIG. 1 is a perspective view illustrating an engaged construction of a cap-integrated pumping type cosmetic container according to a preferred embodiment of the present invention.

The present invention will be described with reference to the accompanying drawings. It is noted that the same reference numerals mean the same elements in each drawing.

Figure 2:
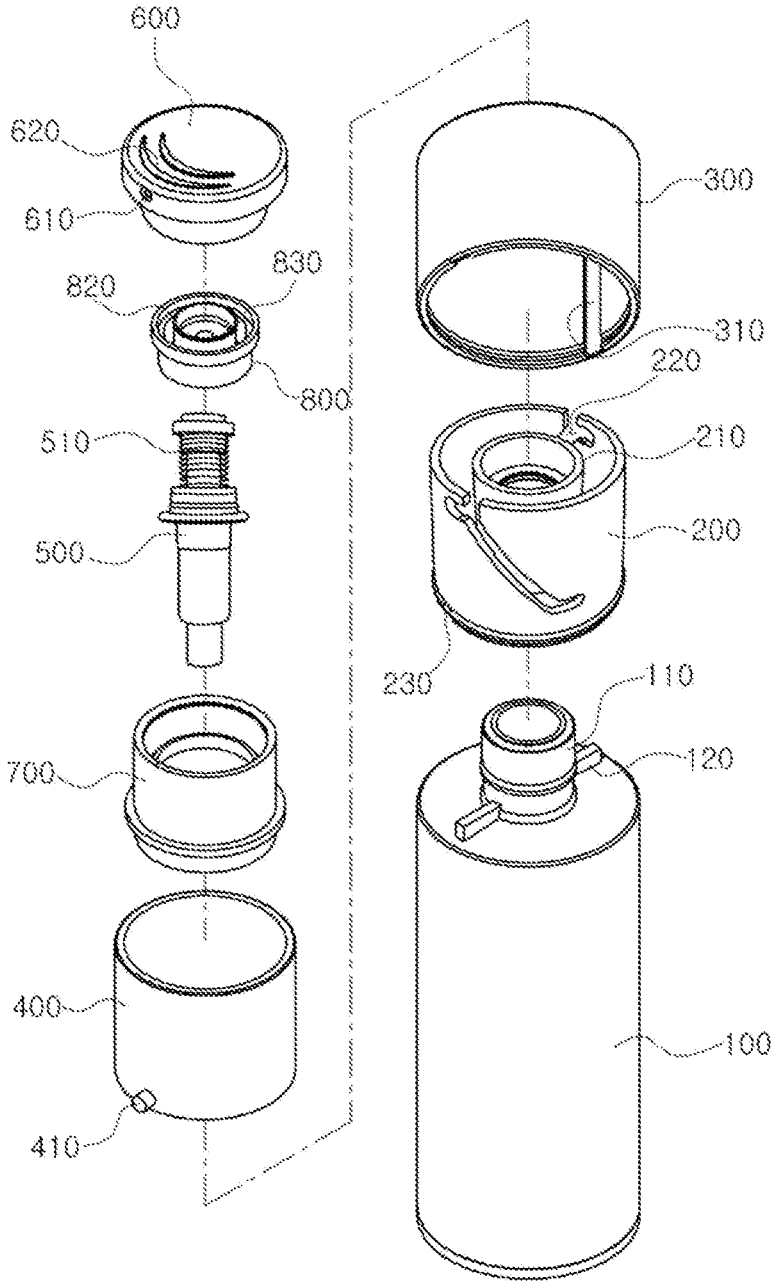
FIG. 2 is a disassembled perspective view illustrating a construction of a cap-integrated pumping type cosmetic container according to a predetermined embodiment of the present invention.
Figure 3:
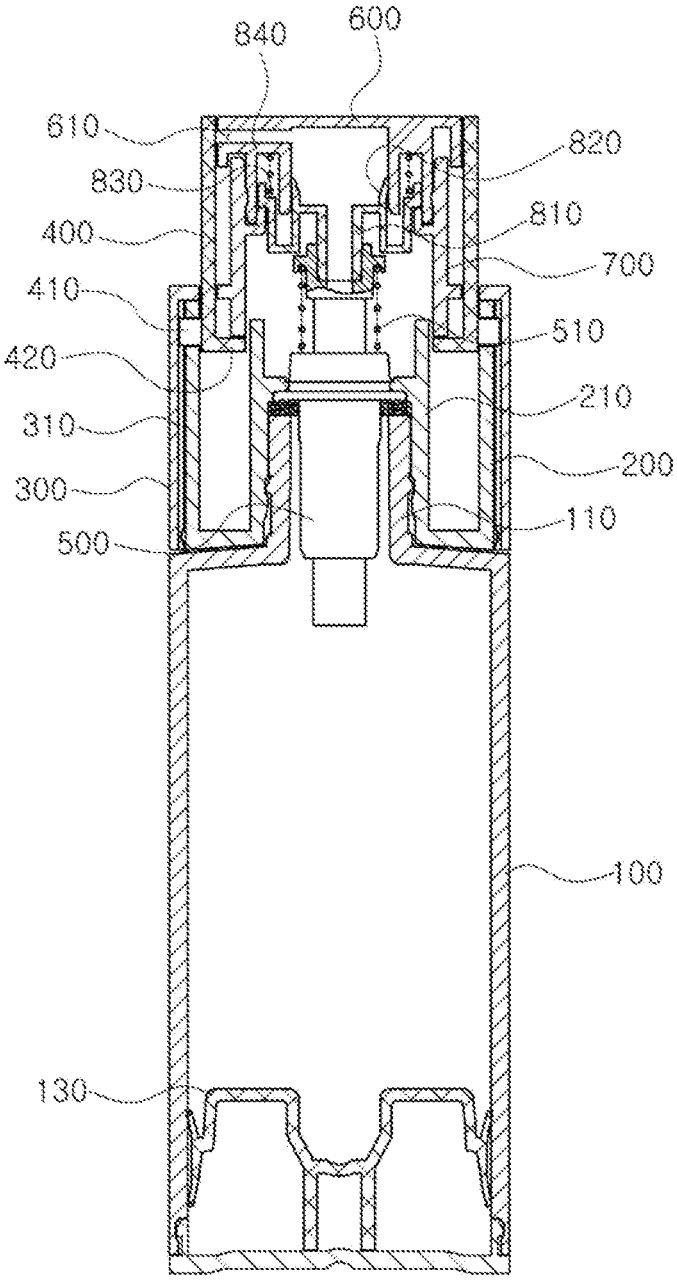
FIG. 3 is a cross sectional view illustrating a construction of a cap-integrated pumping type cosmetic container according to a predetermined embodiment of the present invention.
Figure 4:
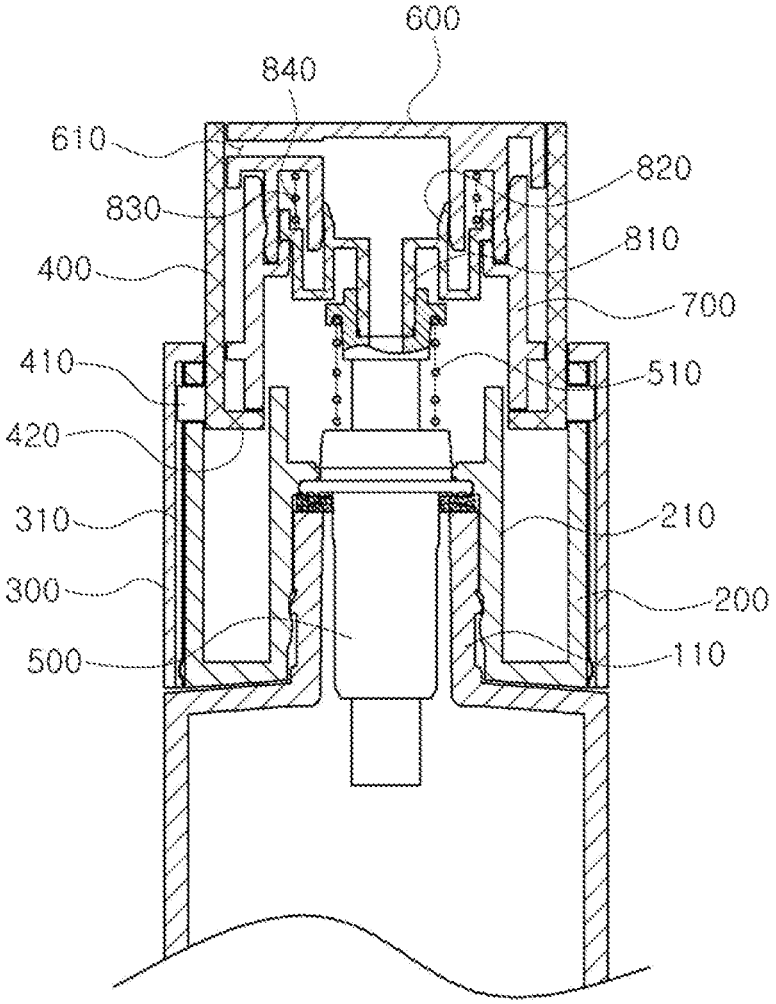
FIGS. 4 to 7 are views for describing the operations of a cap-integrated pumping type cosmetic container according to a predetermined embodiment of the present invention.
Figure 5:
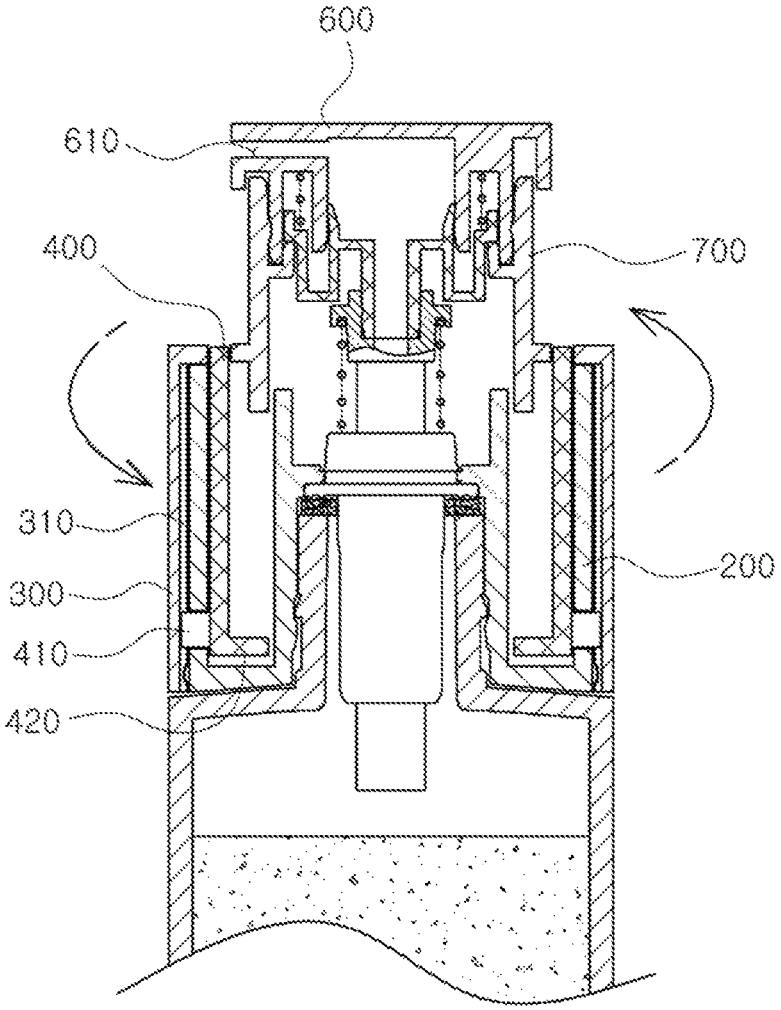
Figure 6:
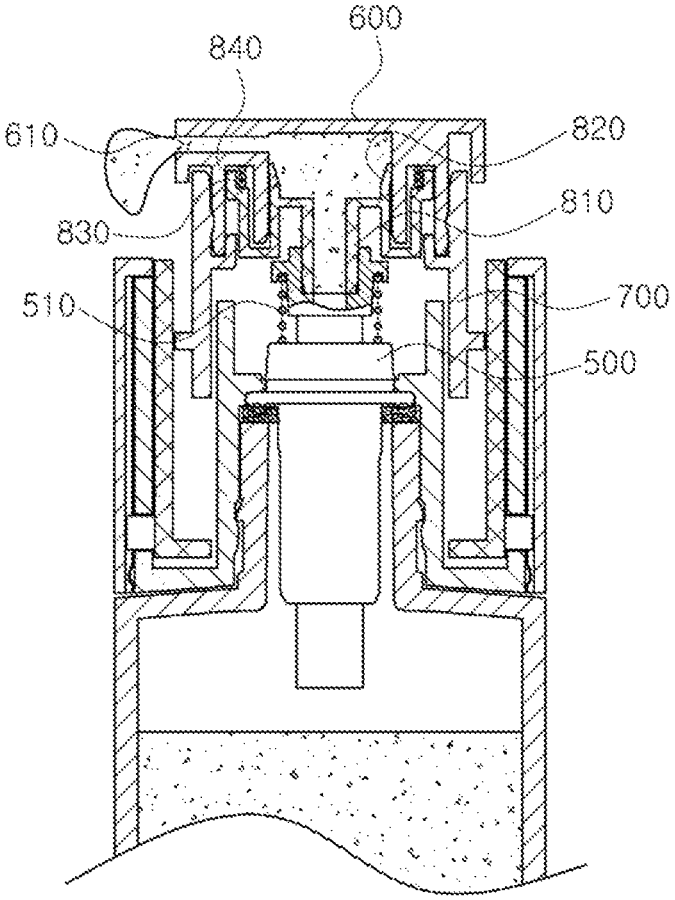
Figure 7:
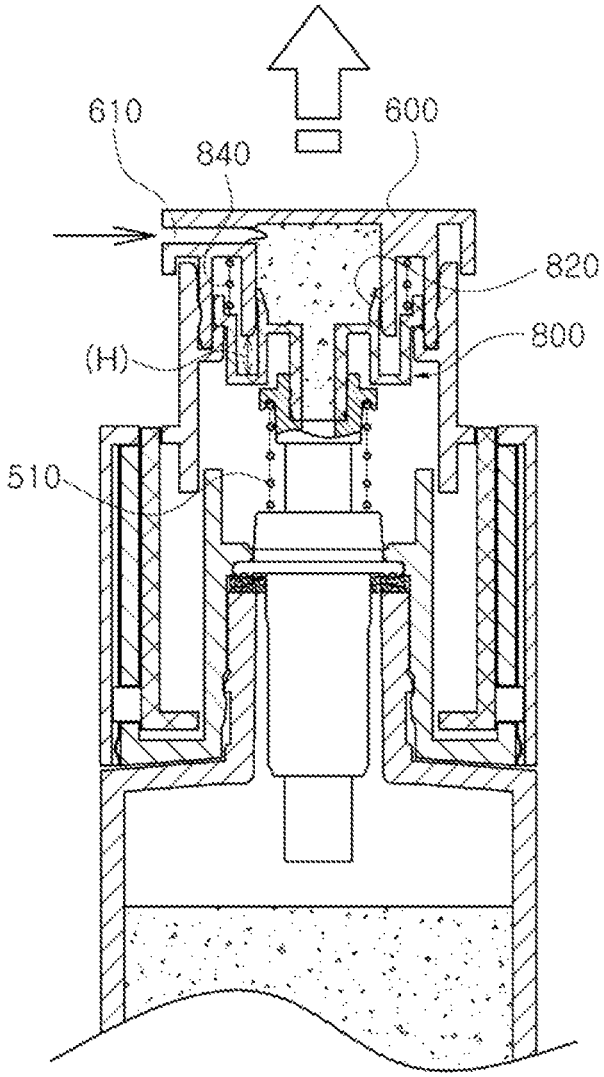

FIG. 1 is a perspective view illustrating an engaged construction of a cap-integrated pumping type cosmetic container according to a preferred embodiment of the present invention. FIG. 2 is a disassembled perspective view illustrating a construction of a cap-integrated pumping type cosmetic container according to a predetermined embodiment of the present invention. FIG. 3 is a cross sectional view illustrating a construction of a cap-integrated pumping type cosmetic container according to a predetermined embodiment of the present invention.

As best seen in FIGS. 1 to 3, the cap-integrated pumping type cosmetic container according to a preferred embodiment of the present invention comprises a container body 100, an ascending and descending guide member 200, a rotation member 300, a cap 400, a pumping member 100 and a button part 600.

The container body 100 serves to store contents and is equipped with in its interior a piston 130 which ascends as the contents are used. At the top of the container body 100 is provided a discharge part 110 which is engaged to the ascending and descending guide member 200 and discharges contents outside.

In the present invention, it has features in that at the top of the container body 100 is provided a rotation prevention protrusion 120 which is capable of preventing the rotations of the ascending and descending guide member 200. Since the rotation prevention protrusion 120 is engaged to the rotation prevention groove 230 formed at the bottom of the ascending and descending guide member 200, the ascending and descending guide member 200 can be prevented from being rotated together when the rotation member 300 rotates.

In the drawings of the present invention, the container body 100 is illustrated as a dispenser container equipped with a piston 130; however it maybe be configured in various types of containers capable of storing contents such as a tube container, a blow forming container, etc.

The ascending and descending guide member 200 is engaged to the discharge part 110 of the container body 100 for thereby guiding the ascending and descending operations of the cap 400 and includes an engaging part 210 having a hollow portion at the center of the inner side for the sake of an engagement to the discharge part 110.

In the present invention, at an outer surface of the ascending and descending guide member 200 is formed a helical groove 220 which helps ascend and descend the cap 400. A guide protrusion 410 of the cap 400 is engaged to the helical groove 220 and moves. It is preferred that a pair of the opposed helical grooves 220 are provided at both sides for the guide protrusion 410 to move stably.

It is preferred that a fixing groove is formed at both ends of the helical groove 220 so that the guide protrusion 410 can rotate upward or move downward along the helical groove 220 and then can be fixed at the top or the bottom.

At the bottom of the ascending and descending guide member 200 is provided a rotation prevention groove 230 which is engaged to the rotation prevention protrusion 120 so as to prevent its rotation when the rotation member 300 rotates.

The rotation member 300 is rotatable-engaged, surrounding the ascending and descending guide member 200, at the top of the container body 100. In the present invention, it has features in that at the inner surface of the rotation member 30 is formed, in a longitudinal direction from the top to the bottom, a vertical guide groove 320 which is engaged to the guide protrusion 410 of the cap 400.

The vertical guide groove 320 serves to guide the vertical movement of the guide protrusion 410 during the rotation of the rotation member 200, so the cap 400 is guided not to rotate but to move only in the upward and downward directions.

The cap 400 ascends and descends in a state that it is inserted in the interior of the ascending and descending guide member 200 and opens and closes the discharge port 610 and is formed in a cylindrical shape surrounding the engaging part 210.

In the present invention, it has featured in that at both sides of the outer surface of the cap 400 is provided a guide protrusion 410 which is inserted into the helical groove 220 and the vertical guide groove 310 for the purpose of guiding the ascending and descending operations of the cap 400. The guide protrusion 410 descends along the helical groove 220 and the vertical guide groove 310 during the rotation of one side of the rotation member 300, as a result of which the cap 400 descends for thereby opening the discharge port 610. The guide protrusion 410 ascends along the helical groove 220 and the vertical guide groove 310 during the rotation of the other side of the rotation member 300, as a result of which the cap 400 ascends for thereby closing the discharge port 610.

In the present invention, it has features in that at the bottom of the inner side of the cap 400 is provided a pumping prevention shoulder 420 which surrounds the inner surface so as to support the bottom of the pumping prevention member 400 engaged to the bottom of the button part 600. In a state that the discharge port 610 is closed as the cap 400 ascends, the pumping prevention shoulder 420 is configured to support the bottom of the pumping prevention member 700. In this case, since the button part 600 is not pressurized, the pumping operation of the pumping member 500 can be substantially prevented, so it is possible to prevent the contents from being leaked owing to error operations.

When the cap 400 is assembled, the cap 400 is integrated with the ascending and descending guide member 200 and the rotation member 300, so the cap 400 can be inserted into or separate from the openings of the top and bottom of the rotation member 300, thus preventing the cap 400 from being lost.

The pumping member 500 is engaged to the discharge part 110 of the container body 100 for thereby performing pumping operations, by which the contents stored in the container body 100 can be discharged outside. When the button part 600 is pressurized, the first spring 510 is contracted and released, which makes the pumping operations possible. Since the pumping member 500 belongs to the conventional art in the same technical field as the present invention, the descriptions thereon will be omitted.

The button part 600 is equipped with a discharge port 610 which is engaged to the top of the pumping member 500 for transferring pressure therethrough to the pumping member 500 as a user presses, so the contents are discharged outside by means of the pumping operations of the pumping member 500.

The discharge port 610 is configured to be closed by the inner wall of the cap 400 when the cap 400 ascends and to be opened when the cap 400 descends. In the present invention, to the bottom of the button part 600 is engaged a pumping prevention member 700 which limits the downward movements of the button part 600.

The pumping prevention member 700 is mounted at the pumping prevention shoulder 420 formed at the bottom of the inner side of the cap 400 when the cap 400 ascends so as to prevent the pressurization of the button part 600, so the downward movement of the button part 600 can be limited. In a state that the discharge port 610 is closed, since the pumping operations of the pumping member 500 are impossible, the leakage of the contents through the discharge port 610 can be substantially blocked.

In the present invention, it has features in that below the button part 600 is provided a content suction part 800 which is engaged to the top of the pumping member 500 and sucks back the contents remaining at the front end of the discharge port 610. The content suction part 800 comprises a content movement tube 810 which is engaged to the top of the pumping member 500 and forms a space through which the contents from the pumping member 500 move, a content suction tube 820 which extends in an upward direction from the content movement tube 810 and comes into close contact with the inner surface of the button part 600, and a spring support shoulder 830 which surrounds the content movement tube 810 at a certain distance and is installed below the button part 600 and supports a second spring 840 providing an elastic force to the button part 600.

The content suction tube 820 is formed in a piston shape which comes into close contact with the inner surface of the button part 600. A vacuum pressure is generated in the interior of the button part 600 when the content suction part 800 and the button part 600 ascend together by an elastic force of the first spring 510, and then the button part 600 independently ascends by means of an elastic force of the second spring 840, for thereby sucking back the contents remaining at the front end of the discharge port 610. Therefore, the unnecessary consumption of the content can be prevented, and the container can be prevented from the contaminations which occur due to the leakage of the contents.

It is preferred that at the top of the button part 600 is provided a pressurization indication portion 620 which indicates the pressurized portion formed based on the direction of the discharge port when the user presses the button part 600.

The operations of the cap-integrated pumping type cosmetic container according to a preferred embodiment of the present invention will be described with reference to the accompanying drawings. FIGS. 4 to 7 are views for describing the operations of the cap-integrated pumping type cosmetic container according to a preferred embodiment of the present invention will be described.

As best seen in FIGS. 4 to 7, the cap-integrated pumping type cosmetic container according to a preferred embodiment of the present invention has features in that the cap 400 ascends as usual and is positioned at a portion where blocks the discharge port 610. At this time, the bottom of the pumping prevention member 700 is mounted at the pumping prevention shoulder 420 of the cap 400 for thereby limiting the downward movement of the button part 600, so the pumping operations of the pumping member 500 are blocked.

When the rotation member 300 is rotated in a state that the cap 300 has ascended, the guide protrusion 410 of the cap 400 moves along the helical groove 220 and the vertical guide groove 310 for thereby descending the cap 400, as a result of which the discharge port 610 which remains blocked by the inner wall of the cap 400, can be opened.

At this time, as the cap 400 descends, the pumping prevention shoulder 420 which is supporting the bottom of the pumping prevention member 700 is spaced apart from the pumping prevention member 700, so the button part 600 can move downward by the press of the button part 600. The pressurization force is transferred to the pumping member 500 as the button part 600 moves downward, so the content can be discharged outside by means of the pumping operations.

When the button part 600 is depressurized in a state that the discharge of the contents is completed, the button part 600 starts ascending. At this time, a vacuum pressure is generated in the interior of the button part 600 by the content suction tube 820 as high as the height "H" that the button part 600 independently ascends by an elastic force of the second spring 840 after the ascending is completed by the first spring 510, so the contents remaining at the front end of the discharge port 610 can be sucked back.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A cap-integrated pumping type cosmetic container, comprising:

a container body which stores cosmetic contents and includes a discharge part including at a top of the container body the discharge part for discharging the contents;

an ascending and descending guide member which is engaged to the discharge part of the container body and includes a pair of opposed helical grooves at both sides of an outer surface;

a rotation member which is rotatable-engaged at the top of the container body and surrounds the ascending and descending guide member and has at an inner surface a vertical guide groove in a longitudinal direction;

a cap which is inserted in the interior of the ascending and descending guide member and ascends and descends therein and has a guide protrusion which is formed at both sides of an outer surface and is inserted into the helical groove and the vertical guide groove;

a pumping member which is engaged to a discharge part of the container body and discharges the contents through pumping operations; and a button part which is engaged to the top to the pumping member and transfers a pressure to the pumping member and has a discharge port which opens and is closed as the cap ascends and descends.

2. The container of claim 1, wherein below the button part is provided a pumping prevention member which is mounted at the bottom of the cap when the cap ascends for thereby limiting a downward movement of the button part.

3. The container of claim 2, wherein at the bottom of an inner side of the cap is provided a pumping prevention shoulder which surrounds an inner surface and supports the bottom of the pumping prevention member.

4. The container of claim 1, wherein to a top of the pumping member is engaged a content suction part which is capable of sucking back the contents remaining at the front end of the discharge port, said content suction part, comprising:

a content movement tube which is engaged to the top of the pumping member and forms a space through which the contents from the pumping member move;

a content suction tube which extends upward from the content movement tube and comes into close contact with an inner surface of the button part; and a spring support shoulder which surrounds the content movement tube at a certain distance and supports a second spring installed at the bottom of the button part and provides an elastic force to the button part.

5. The container of claim 4, wherein the content suction tube is formed in a piston shape which comes into close contact with an inner surface of the button part, and a vacuum pressure is generated in the interior of the button part when the button part ascends by means of an elastic force of the second spring, for thereby sucking back the contents remaining at a front end of the discharge port.

6. The container of claim 1, wherein at the top of the container body is provided a rotation prevention protrusion configured to prevent the rotation of the ascending and descending guide member, and at the bottom of the ascending and descending guide member is formed a rotation prevention groove which is engaged to the rotation prevention protrusion.

* * * * *